United States Patent [19]

Kirjanov et al.

[11] Patent Number: 4,813,970

[45] Date of Patent: Mar. 21, 1989

[54] METHOD FOR IMPROVING THE LIGHTFASTENESS OF NYLON DYEINGS USING COPPER SULFONATES

[75] Inventors: Alexander S. Kirjanov, Reading, Pa.; Vincent W. Bannigan, Jr., Concord, N.C.

[73] Assignee: Crompton & Knowles Corporation, Stamford, Conn.

[21] Appl. No.: 154,341

[22] Filed: Feb. 10, 1988

[51] Int. Cl.[4] ..... D06P 5/02; D06P 5/10

[52] U.S. Cl. ..... 8/442; 8/624; 8/724

[58] Field of Search ..... 8/442, 490, 492, 587, 8/624, 924, DIG. 21

[56] References Cited

U.S. PATENT DOCUMENTS

| | | | |
|---|---|---|---|
| 4,253,843 | 3/1981 | Bannigan, Jr. | 8/442 |
| 4,383,835 | 5/1983 | Preuss et al. | 8/624 |
| 4,544,372 | 10/1985 | Heise et al. | 8/624 |
| 4,613,334 | 9/1986 | Thomas et al. | 8/442 |

*Primary Examiner*—Paul Lieberman
*Assistant Examiner*—Helene Kirschner
*Attorney, Agent, or Firm*—Bernard Francis Crowe

[57] ABSTRACT

This invention is directed to a method for the lightfastness enhancement of dyed nylon fibers by applying at least 10 ppm copper in the form of an alkyl, aryl, or alkyl-aryl copper sulfonate before, during, or after dyeing the nylon fibers.

20 Claims, No Drawings

METHOD FOR IMPROVING THE LIGHTFASTENESS OF NYLON DYEINGS USING COPPER SULFONATES

BACKGROUND OF INVENTION

This invention relates to a method for enhancing the lightfastness of dyed nylon textile fibers.

Heretofore, it has been known to improve the lightfastness of dyed nylon fabrics by treating the fibers with aqueous solutions containing copper in the form of cupric ion. The copper was applied as a water soluble copper salt, usually copper sulfate or copper acetate that was added directly to the dyebath and deposited on the fiber simultaneously with the dye. But because the copper is soluble, it has a very poor affinity for the nylon, and therefore any absorbed copper can be easily washed off the fiber in the normal wet treatments to which fibers are subjected in processing. This results in uneven distribution of the copper on the fiber and its impact on lightfastness will not be uniform.

In addition, because of its high solubility, the use of the soluble copper salts gives rise to effluent problems in disposing of spent dyebath liquors and the water used in washing the dyed fabric. Moreover, when soluble copper salts are added to the dye baths, in many commonly used dyeing processes, the pH conditions during the dyeing cycle are such that the copper can precipitate as copper hydroxide, which, in temperatures are employed to accelerate the exhaustion and fixation of the dyes on the fiber. Copper oxide objectionably discolors the dyed nylon (imparting a black or brown coloration thereto), does not exhaust in a level manner, and frequently "builds up" on and contaminates the dyeing vessel.

To solve the above problems, U.S. Pat. No. 4,253,843 teaches the use of copper phosphate, which is now being successfully employed by the industry. However, several important problems remain to be overcome. One is the need to adjust the pH very carefully to form colloidal copper phosphate which then exhausts onto the nylon substrate. This is not always easy under prevailing industrial conditions. Moreover, the processing conditions may require pH values at which copper phosphate becomes soluble and is partially extracted from the fiber into the treating bath. This in itself is not an important problem from the standpoint of lightfastness enhancement because an excess of copper phosphate may be used; however, it creates an environmental problem when the bath is disposed of since copper is a regulated water pollutant.

To obviate the copper pollution problem in manufacturing facilities that have no means to control such pollution, it was attempted to spray acid solutions of copper phosphate, and other soluble salts such as copper sulfate, onto the dyed nylon substrate before the drying step. Such a method would deposit all the copper onto the nylon substrate without losses into the environment.

Unfortunately when spraying and drying such copper salt solutions, especially strongly acid solutions, we encountered objectionable discoloration of the dyeings, harshness of hand and, occasionally insufficient lightfastness improvement.

In attempting to solve some of the above problems, a number of inventions have been granted patents in recent years, such as U.S. Pat. Nos. 4,383,835; 4,544,372; 4,613,334. The commonality of all these patents is the use of water-insoluble copper complexes which are applied in the form of solid dispersions in water. These products generally require no accurate pH adjustment and are insoluble in a wide pH range. However, none of these products exhausts on the nylon substrate completely (to a 100% exhaustion) and thus copper is still found in the effluent after their application. Moreover, these solid dispersions in water are insufficiently stable to afford the possibility of spray application because they will build up in the spray nozzles and eventually obstruct them. They could be applied by padding, but dipping and squeezing a textile substrate always results in residual liquid which must be discarded. The residual liquid cannot be reused in most cases because it becomes contaminated with dye from the treated substrate. Also, pad applications will deposit too much moisture which must then be evaporated, resulting in extra time and energy costs.

SUMMARY OF INVENTION

The object of our invention is to provide a method for applying copper to polyamide in the form of a soluble copper compound from a liquor without having to adjust the pH of this liquor to a specific value, and, more importantly, to provide a soluble copper compound which can also be sprayed in solution form onto polyamide substrates and dried, thus providing enhanced lightfastness without discoloration, without imparting harshness to the fiber, and without any copper contamination of the environment.

Such soluble copper compounds are copper sulfonates of the following types:

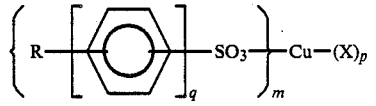

(A)

Where

R=H, OH, $C_nH_{2n+1}$; n=1–20 m=1 or 2, when m=2, then p=0 when m=1, then p=1 and X=OH, carboxylic acid, halogen inorganic acid, or an oxygenated inorganic acid.

q=0 or 1, when q=0, then R=$C_nH_{2n+1}$; n=9–20

The preferred compounds are those where

R=$C_nH_{2n+1}$ and n=9–16,

P=0, m=2, and q=1, and most especially

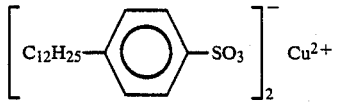

[I]

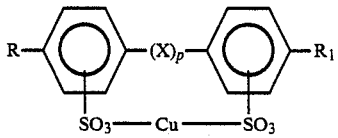

(B)

Where

R and $R_1$=H, OH, $C_nH_{2n+1}$, n=1–20

R can be the same as $R_1$, or different from $R_1$ p=0 or 1; when p=1, the nX=0,

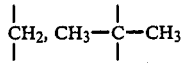

The preferred compounds are those where
$R=C_nH_{2n+1}$, n=9–16;
$R_1$=R or H
P=1, and X=0
and most particularly

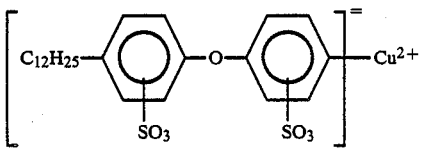

[II]

For convenience both compounds [I] and [II] are used as aqueous solutions containing 2.0% copper.

EXAMPLES OF INVENTION

The illustrative examples, though not inclusive, show how to apply copper to the polyamide substrate in amounts sufficient to impart improved lightfastness. This amount will vary depending on the shade, substrate, and degree of lightfastness required, but the minimum amount required on the polyamide substrate is at least 10 ppm by weight of copper, and preferably at least 50 ppm by weight of copper.

Lightfastness was determined by comparing unexposed areas of dyeings to areas exposed to energy generated in an Atlas Weather-Ometer, Model Ci-65. This Xenon-Arc testing device measures the degree of exposure to light in kilojules. Calibration is achieved by exposure of a fading standard. (AATCC, L.2 wool blue).

Examples 1, 1-A, 1-B and 1-C and polyamide fabrics dyed by exhaust at 100° C. from a water bath containing:
Acid Orange 162
Acid Red 182
Acid Black 132
and Acid to pH 5.5. which is required to exhaust the above dyes on nylon. Dyeing was complete at 45 minutes. Example 1 was rinsed in cold water and dried. Example 1-A, 1-B and 1-C were run an additional 20 minutes at 70° C. with the addition of:
2.0% OWF Compound Type [I] Example (1-A) (no pH adjustment)
2.0% OWF Compound Type [II] Example (1-B) (no pH adjustment)
1.0% OWF Compound of Copper Phosphate (U.S. Pat. No. 4,253,843) (pH adjusted to 7.0) Example (1-C)
These dyeings were rinsed in cold water and dried.

Examples 2 thru 5 are polyamide fabric dyed from a water bath and subsequently treated with:
Compound [I] Examples labeled suffix (-A) or
Compound [II] Examples labeled suffix (-B)
Treatment is achieved by topical spray at 21° C. of a water solution containing 30 g/l of Compound [I] or Compound [II]. Spray level is at 20% add on, producing a 0.60% o.w.f. application of Compound [I] or Compound [II]. Fabric is dried with hot air at 90° C.

Examples 2, 2-A, 2-B, 2-C, 2-D, 3, 3-A, 3-B, 3-C, 3-D are polyamide fabric dyed continuously from a water bath containing:
Acid Orange 162
Acid Red 182
Acid Black 132
A sulfonated ester wetting agent
A modified guar gum thickner
Acetic Acid to pH 7.0, which is required for a level dyeing.
Fabrics were steamed 8 minutes at 100° C., rinsed in cold water and dried.

Examples 2, 3 were dyed only.

Examples 2-A, 2-B, 2-C, 2-D, 3-A, 3-B, 3-C, 3-D were sprayed with 20% add on of the following water solutions at 21° C. and air dried at 90° C.
10 G/L Solution of Compound [I] Examples 2-A, 3-A
30 G/L Solution of Compound [I] Examples 2-B, 3-B
10 G/L Solution of Compound [II] Examples 2-C, 3-C
30 G/L Solution of Compound [II] Examples 2-D, 3-D
Examples 4 and 4-A are polyamide carpet dyed continuously from a water bath containing:
Acid Orange 162
Acid Red 182
Acid Black 131
A sulfonated ester wetting agent
A modified guar gum thickener
Acetic Acid to pH 6.0, required for a level dyeing.
Fabrics were steamed 8 minutes at 100° C., rinsed in cold water and dried.

Example 4 was dyed only. Example 4-A was sprayed with 20% add on of a water solution of 30 G/L Compound [I].

Examples 5 and 5-A are polyamide carpet dyed continuously from a water bath containing:
Acid Yellow 129
Acid Red 182
Acid Black 131
A sulfonated ester wetting agent
A modified guar gum thickner
Acetic Acid to pH 6.0, required for a level dyeing.
Fabrics were steamed 8 minutes at 100° C., rinsed in cold water and dried.

Example 5 was dyed only.

Example 5-A was sprayed with 20% add on of a water solution of 30 G/L Compound [I].

Tabulation of Lightfastness Test Results

The degree of lightfastness was rated by visual assessment of color change comparing exposed dyeing to unexposed dyeing. Degree of color change is expressed by rating with a scale from 1—extreme color change thru 5—no color change, as established by the AATCC Gray Scale, (ISO International Standard R 105/1).

| EXAMPLE | EXPOSURE kj | GRAY SCALE COLOR CHANGE |
|---|---|---|
| 1 | 375 | 1–2 |
| | 450 | 1 |
| 1-A | 375 | 3–4 |
| | 450 | 3–4 |
| 1-B | 375 | 3–4 |
| | 450 | 3–4 |
| 1-C | 375 | 3–4 |
| | 450 | 3 |
| 2 | 150 | 3 |
| | 225 | 2 |
| 2-A | 150 | 4–5 |
| | 225 | 4 |

-continued

| EXAMPLE | EXPOSURE kj | GRAY SCALE COLOR CHANGE |
|---|---|---|
| 2-B | 150 | 4–5 |
| | 225 | 4 |
| 2-C | 150 | 4–5 |
| | 225 | 4 |
| 2-D | 150 | 4–5 |
| | 225 | 4 |
| 3 | 150 | 3 |
| | 225 | 1–2 |
| 3-A | 150 | 4 |
| | 225 | 3–4 |
| 3-B | 150 | 4–5 |
| | 225 | 3–4 |
| 3-C | 150 | 4 |
| | 225 | 3–4 |
| 3-D | 150 | 4–5 |
| | 225 | 3–4 |
| 4 | 75 | 2–3 |
| | 120 | 1–2 |
| 4-A | 75 | 4–5 |
| | 120 | 4–5 |
| 5 | 75 | 2–3 |
| | 120 | 1–2 |
| 5-A | 75 | 4–5 |
| | 120 | 4 |

I claim:

1. The method of improving the lightfastness of dyed nylon textile fibers which method comprises applying and drying a soluble copper sulfonate of the following formula

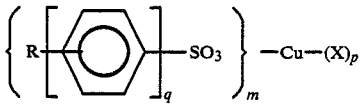

onto the fibers from a solvent system or from an aqueous bath; the deposition of the soluble copper sulfonate being effected before, simultaneously with, or after the dye has been applied to the fibers.

2. The method according to claim 1:

where

R=H, OH, $C_nH_{2n+1}$; n=1–20 m=1–2 x=OH, carboxylic acid, halogen inorganic acid, or an oxygenated inorganic acid q=0–1 p=0 or 1.

3. The method according to claim 1 wherein the soluble copper sulfonate is of the following formula:

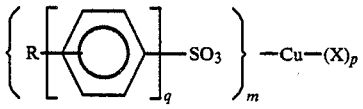

R=$C_nH_{2n+1}$ and n=9–16, p=0, m=2, and q=1

4. The method according to claim 1 wherein the soluble copper sulfonate is of the following formula:

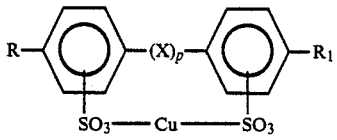

where

R and $R_1$=H, OH, $C_nH_{2n+1}$, n=1–20, p=0 or 1

X=O,

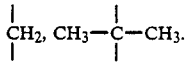

5. The method according to claim 1 wherein the soluble copper sulfonate is of the following formula:

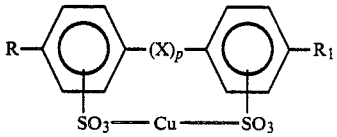

where

R=$C_nH_{2n+1}$, n=9–16

$R_1$=R or H p=1, and X=0.

6. The method according to claim 1 wherein the copper sulfonate is applied by an Exhaust Application.

7. The method according to claim 1 wherein the copper sulfonate is applied by a continuous application.

8. The method according to claim 1 wherein the application is by padding.

9. The method according to claim 1 wherein the copper sulfonate is sprayed as an aqueous solution onto the fiber substrate and dried.

10. The method according to claim 1 wherein the copper sulfonate is sprayed as a solvent solution onto the fiber substrate and dried.

11. The method according to claim 1 wherein the minimum amount required is at least 10 parts per million of copper in the form of Copper sulfonate.

12. The method according to claim 1 wherein the application of the copper sulfonate is carried out under pressure and at elevated temperatures below the boiling point of the bath or system at the prevailing pressure.

13. The method according to claim 1 wherein the application of the copper sulfonate is carried out from a solvent system or from an aqueous bath maintained at elevated temperatures approaching the boiling point of the system or bath.

14. The method according to claim 6 wherein the copper sulfonate is applied by passing the textile fibers through an aqueous bath containing the copper sulfonate and after the fibers have passed through the bath subjecting to heating the wetted fibers under time and temperature conditions and then dried.

15. The method according to claim 6 wherein the copper sulfonate is applied by passing the textile fibers through an aqueous bath containing the copper sulfonate and after the fibers have passed through the bath subjecting them to steaming for a sufficient time to cause the copper sulfonate to penetrate beneath the surface of the fibers.

16. The method according to any one of claims 1 to 15 wherein the fibers undergoing treatment are undyed.

17. The method according to any one of claims 1 to 15 wherein the fibers have been dyed prior to the deposition of the copper sulfonate thereon.

18. The method according to any one of claims 1 to 15 wherein the solvent system or aqueous copper sulfonate bath also contains a dye capable of dyeing the nylon fibers undergoing treatment.

19. As an article of manufacture a nylon textile treated by the method of any one of claims 1 to 18.

20. The method according to claim 11 wherein the amount of copper in the form of copper sulfonate is at least 50 parts per million.

* * * * *